US009183816B2

(12) United States Patent
Brawley

(10) Patent No.: US 9,183,816 B2
(45) Date of Patent: Nov. 10, 2015

(54) PROTECTIVE SYSTEM

(71) Applicant: Pamela Brawley, Oakland, CA (US)

(72) Inventor: Pamela Brawley, Oakland, CA (US)

( * ) Notice: Subject to any disclaimer, the term of this patent is extended or adjusted under 35 U.S.C. 154(b) by 28 days.

(21) Appl. No.: 14/159,415

(22) Filed: Jan. 20, 2014

(65) Prior Publication Data

US 2014/0130338 A1 May 15, 2014

Related U.S. Application Data

(63) Continuation-in-part of application No. 13/563,704, filed on Jul. 31, 2012, now Pat. No. 8,637,756.

(51) Int. Cl.
*G10D 9/00* (2006.01)
*G10G 7/00* (2006.01)

(52) U.S. Cl.
CPC ..... *G10D 9/00* (2013.01); *G10G 7/005* (2013.01); *Y10T 29/49998* (2015.01)

(58) Field of Classification Search
CPC ..... A45F 5/14; A63B 49/18; G10D 9/00; G10D 13/003; G10D 13/02; G10D 9/023; G10D 9/06; G10G 7/005; G10G 5/00; A45C 11/00; A45C 13/002; A45C 9/00; B25G 1/102; B65D 85/04; B65D 85/70
USPC ..... 84/453, 327, 329, 290; 206/314
See application file for complete search history.

(56) References Cited

U.S. PATENT DOCUMENTS

| | | | | |
|---|---|---|---|---|
| 3,230,814 | A | 1/1966 | Welts | |
| 4,084,477 | A | 4/1978 | Dominguez | |
| 5,219,075 | A * | 6/1993 | White | 206/314 |
| 7,090,313 | B1 | 8/2006 | McMurray | |
| 7,453,034 | B2 | 11/2008 | Johnson | |
| 7,488,881 | B2 | 2/2009 | Kessler | |
| 7,671,264 | B1 | 3/2010 | Heda | |
| 7,956,270 | B1 * | 6/2011 | Burmeister et al. | 84/453 |
| 8,087,513 | B2 | 1/2012 | Kriesel | |
| 2002/0011389 | A1 | 1/2002 | Intini | |
| 2006/0027472 | A1 | 2/2006 | Gokcen | |
| 2008/0216633 | A1 | 9/2008 | Winch | |
| 2008/0230413 | A1 | 9/2008 | Taninbaum | |
| 2010/0122755 | A1 | 5/2010 | Post | |
| 2010/0170811 | A1 | 7/2010 | Coppiardi | |
| 2011/0088532 | A1 | 4/2011 | Klemp | |
| 2011/0253568 | A1 | 10/2011 | Wright | |

* cited by examiner

*Primary Examiner* — Kimberly Lockett

(74) *Attorney, Agent, or Firm* — Quine Intellectual Property Law Group, P.C.; Gary Baker

(57) ABSTRACT

A protective system includes a protective multi-layered body portion for protecting an instrument from debris, wind, temperature extremes, and visual observation. The body portion encapsulates the instrument fully assembled, so that a user has to remove the cover to utilize the instrument. The body portion minimizes contact with instrument. The body portion includes multiple layers. Each layer provides a unique, novel function for protection of the instrument. An inner layer engages the instrument. An intermediate layer contours to the shape of the instrument and provides insulation. An exterior layer forms the exterior protective surface and includes a pouch and a handle. Outside the body portion, a fastener regulates access to the inside. Inside the body portion, an instrument enhancing device, such as silica packs help protect the instrument. At least one wire carries a current along the body portion to provide heat for the instrument from an external source.

18 Claims, 16 Drawing Sheets

PROTECTIVE SYSTEM

CROSS-REFERENCE TO RELATED APPLICATIONS

The present continuation patent application claims priority benefit under 35 U.S.C. 120 of the U.S. nonprovisional patent application Ser. No. 13/563,704 entitled "Multi-Layered Brass & Woodwind Instrument Cover," filed on 31 Jul. 2012. The contents of this related patent application is incorporated herein by reference for all purposes to the extent that such subject matter is not inconsistent herewith or limiting hereof.

RELATED CO-PENDING U.S. PATENT APPLICATIONS

The following related U.S. patent application(s), submitted by at least one of the present Applicant(s)/Inventor(s) is/(are) recently co-pending: U.S. utility patent application Ser. No. 13/563,704 entitled "Multi-Layered Brass & Woodwind Instrument Cover" submitted to the United States Patent and Trademark Office (USPTO) on 31 Jul. 2012

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to protective covers. More particularly, one or more embodiments of the invention relate to a protective system that at least partially covers musical instruments.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that covers are used to overlay an object and inhibit access by elements, such as wind, moisture, debris, and even visual access.

In many instances, a cover is a material or fabric used to protect, conceal, and enhance an object. The cover is fabricated from materials useful for the purpose. Often, a thick, multilayer cover provides insulation to protect an object from cold. A thin, transparent cover can display a silhouette of the object.

An instrument is often sensitive due to its functionality of providing more refined operation. For example, a musical instrument is a device created or adapted for the purpose of making musical sounds. The musical instrument contains keys, valves, and channels that may be susceptible to exterior elements that damage these components.

Additionally, it is advantageous to protect the musical instrument from visual observation. Human nature has a proclivity to practice or work when the instrument for performing the job is visibly observable. A musical instrument, though covered, may provide incentive for a user to practice.

Typically, instrument cases serve as essential protection and covering for instruments during transportation and/or storage. Some cases provide protection from weather changes or environments that may be hazardous to the instrument. However, the instrument must often be disassembled prior to compacting into the instrument case.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A illustrates an exemplary protective system from a top view, and FIG. 1B illustrates an exemplary protective system form a bottom view, in accordance with an embodiment of the present invention;

FIG. 3A illustrates a first embodiment of an exemplary protective system, and FIG. 3B illustrates a second embodiment of an exemplary protective system, in accordance with an embodiment of the present invention;

FIG. 4A illustrates a side view of an exemplary protective system adjacent to an exemplary instrument, and FIG. 4B illustrates a top view of an exemplary instrument covered by an exemplary protective system, in accordance with an embodiment of the present invention;

FIG. 5A illustrates an exemplary clarinet, FIG. 5B illustrates an exemplary instrument flute, FIG. 5C illustrates an exemplary piccolo, FIG. 5D illustrates an exemplary straight soprano saxophone, and FIG. 5E illustrates an exemplary English horn, FIG. 5F illustrates an exemplary trombone, FIG. 5G illustrates an exemplary trumpet, FIG. 5H illustrates an exemplary tuba, FIG. 5I illustrates an exemplary flugelhorn, FIG. 5J illustrates an exemplary French horn, FIG. 5K illustrates an exemplary euphonium, FIG. 5L illustrates an exemplary bassoon, and FIG. 5M illustrates an exemplary trombone, and an exemplary instrument stand in accordance with an embodiment of the present invention;

FIG. 6A illustrates a top view with an exemplary handle, and FIG. 6B illustrates a bottom view with access to an exemplary inner layer, in accordance with an embodiment of the present invention;

FIG. 8A illustrates an exemplary support side pole, bottom ring, and protective foam top FIG. 8B illustrates a cylindrical exemplary instrument cover, with an exemplary pole sleeve receiving a support pole, a ring sewn in bottom, and foam inserted in top of exemplary instrument cover and FIG. 8C illustrates an exemplary cylindrical instrument enhancing device in accordance with an embodiment of the present invention;

FIG. 9A illustrates a sectioned view of an inner layer, an intermediate layer, and an exterior layer, and FIG. 9B illustrates an exemplary body portion with an exemplary handle and hoop, in accordance with an embodiment of the present invention;

FIG. 10A illustrates an support pole, FIG. 10B illustrates an exemplary pole sleeves receiving support poles, a ring sewn in bottom of exemplary instrument cover, and foam inserted in top of exemplary instrument cover, and FIG. 10C illustrates an exemplary handle and an exemplary hoop on an exterior layer of a body portion, in accordance with an embodiment of the present invention;

FIG. 11A illustrates the body portion removed from the instrument in an upward direction, and FIG. 11B illustrates an instrument enabling entry of an exemplary support pole for providing support, in accordance with an embodiment of the present invention.

Figure 1A:
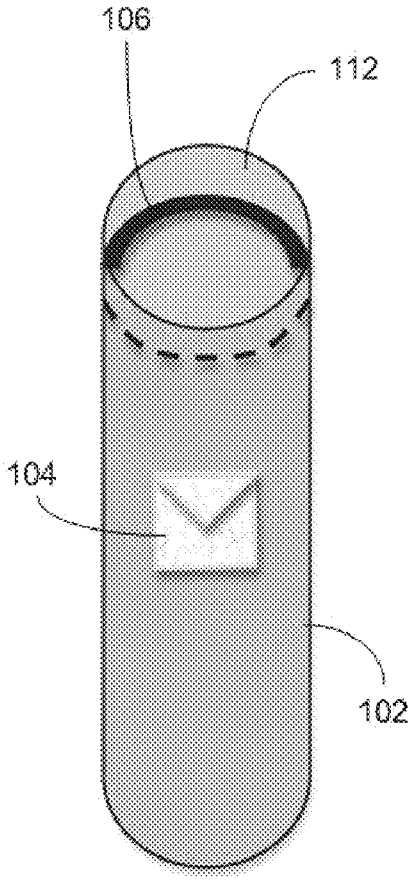
FIGS. 1A and 1B illustrate detailed perspective views of exemplary protective systems overlaying an instrument, where

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. Thus, the present invention is not limited to any particular tangible means of implementation.

The present invention will now be described in detail with reference to embodiments thereof as illustrated in the accompanying drawings.

There are various types of protective systems that may be provided by preferred embodiments of the present invention. In some embodiments, a protective system may provide a protective multi-layered barrier for protecting an instrument from debris, wind, temperature extremes, and visual observation. The instrument may include a musical instrument, such as a woodwind and a brass instrument. Each layer may provide a unique, novel function for protection of the instrument. The protective system may be specially configured to contour the shape of the instrument and provide unique features efficacious and useful only for the specific instrument.

In some embodiments, the protective system may provide a multi-layered cover that protects an instrument against damage, including, without limitation, scratching, denting, chipping, tarnishing, dust, and some mild temperature variances. The instrument may include a woodwind musical instrument and/or a brass musical instrument. The protective system may utilize a multi-layered body portion having multiple layers, with each layer providing a specific function to protect the instrument.

The body portion may protect the instruments against damage, including, without limitation, scratching, denting, chipping, tarnishing, moisture, dust, and mild temperature variances. In one embodiment of the present invention, the instrument cover may be configured to cover an instrument without requiring that the instrument be disassembled. In this manner, a fully assembled, ready to play instrument may be visibly positioned on an instrument stand for facilitated accessibility and availability. Also, by covering the instrument while fully assembled, the instrument may withstand less attrition to the joints and components from repetitive assembling and disassembling. Those skilled in the art, in light of the present teachings will recognize that when the instrument is fully assembled and easily accessible through a soft cover, such as the instrument cover, a user may have greater incentive to utilize the instrument.

In one embodiment of the present invention, the instrument cover may include a body portion that encapsulates the instrument. The body portion may include one whole piece, or multiple sections that join together around the instrument. The body portion may include a top end and a bottom end. In some embodiments, the body portion may include a multiplicity of material layers and components that create a synergy to provide protection, accessibility, and aesthetics to the instrument cover. The body portion may include an inner layer for engaging the instrument. The inner layer may include a soft material that will not damage the instrument. In one embodiment of the present invention, the body portion may include at last one intermediate layer for insulating and retaining the form and contour of the instrument cover. The body portion may further comprise an exterior layer for providing a protective surface.

Those skilled in the art, in light of the present teachings will recognize that the intermediate layer may be configured to conform to multiple sizes, shapes, and dimensions of instruments, including, without limitation woodwinds, and brass instruments. In one embodiment of the present invention, the body portion may include an exterior layer for providing an exterior surface to the instrument cover. The exterior layer may include both functional and aesthetic features. The exterior layer may include at least one pouch for holding instrument components, including, without limitation, a reed case, a mouthpiece, and a tuner. In one embodiment of the present invention, the exterior layer may include a handle for orienting and positioning the instrument cover on and/or off of the instrument.

Figure 1B:
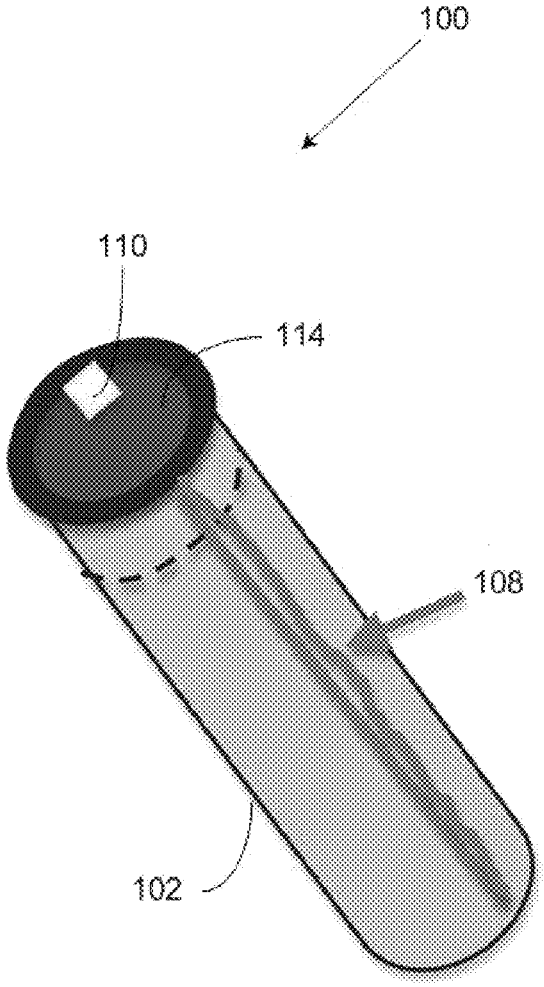

FIGS. 1A and 1B illustrate detailed perspective views of exemplary protective systems overlaying an instrument, where FIG. 1A illustrates an exemplary protective system from a top view, and FIG. 1B illustrates an exemplary protective system form a bottom view, in accordance with an embodiment of the present invention. In the present invention, a protective system 100 may provide a protective multi-layered barrier for protecting an instrument from debris, wind, temperature extremes, and visual observation. The instrument may include a musical instrument, such as a woodwind and a brass instrument. Each layer may provide a unique, novel function for protection of the instrument. The protective system may be specially configured to contour the shape of the instrument and provide unique features efficacious and useful only for the specific instrument. Those skilled in the art, in light of the present teachings will recognize that when the instrument is fully assembled and easily accessible through a soft cover, such as the instrument cover, a user may have greater incentive to utilize the instrument.

The protective system may include a body portion 102 that encapsulates the instrument. The body portion is configured to cover, but not touch or rub against the instrument. The body portion may include one whole piece of material, or multiple sections that join together around the instrument. The body portion may include a top end 112 and a bottom end 114. The instrument may be covered by the body portion from the bottom end. However in other embodiments, the side may provide a system fastener 108 that regulates access to the inside of the body portion from any section of the body cover. The system fastener may include, without limitation, a zipper, buttons, pins, a magnet, Velcro, a hook and loop fastener, and an adhesive.

Those skilled in the art, in light of the present teachings will recognize that the instrument cover may be configured to cover an instrument without requiring that the instrument be disassembled. In this manner, the covered instrument may be positioned on an instrument stand ready to be utilized instantly for facilitated accessibility and availability. Also, by covering instrument fully assembled, the instrument may withstand less attrition to the joints and components from repetitive assembling and disassembling.

In some embodiments, the body portion may include a multiplicity of material layers and components that create a synergy to provide protection, accessibility, and aesthetics to the instrument cover. The body portion may include an inner layer 202 for engaging the instrument. The inner layer may include a soft material that will not damage the instrument. In one embodiment of the present invention, the body portion may include at last one intermediate layer 204 for insulating and retaining the form and contour of the instrument cover. In one embodiment of the present invention, the body portion may include an exterior layer 206 for providing an exterior surface to the instrument cover. The exterior layer may include both functional and aesthetic features. The exterior layer may include at least one pouch 104 for holding an object pertinent to the instrument. The instrument components may include, without limitation, a tuner, a reed case, a mouthpiece, an oil bottle, sanitation wipes, and drinking water. In one embodiment of the present invention, the exterior layer may include a handle 106 for orienting and positioning the instrument cover on and/or off of the instrument. The handle may include a strap configured to be operable to be held by a hand, or passed around the back. In one embodiment of the present invention, a lower inside portion of the body may include an instrument enhancing device 110, such as moisture and/or odor absorbing packs. Additional instrument protection may include, without limitation, a gel silica pack, baking soda, and an alarm system.

Figure 2:
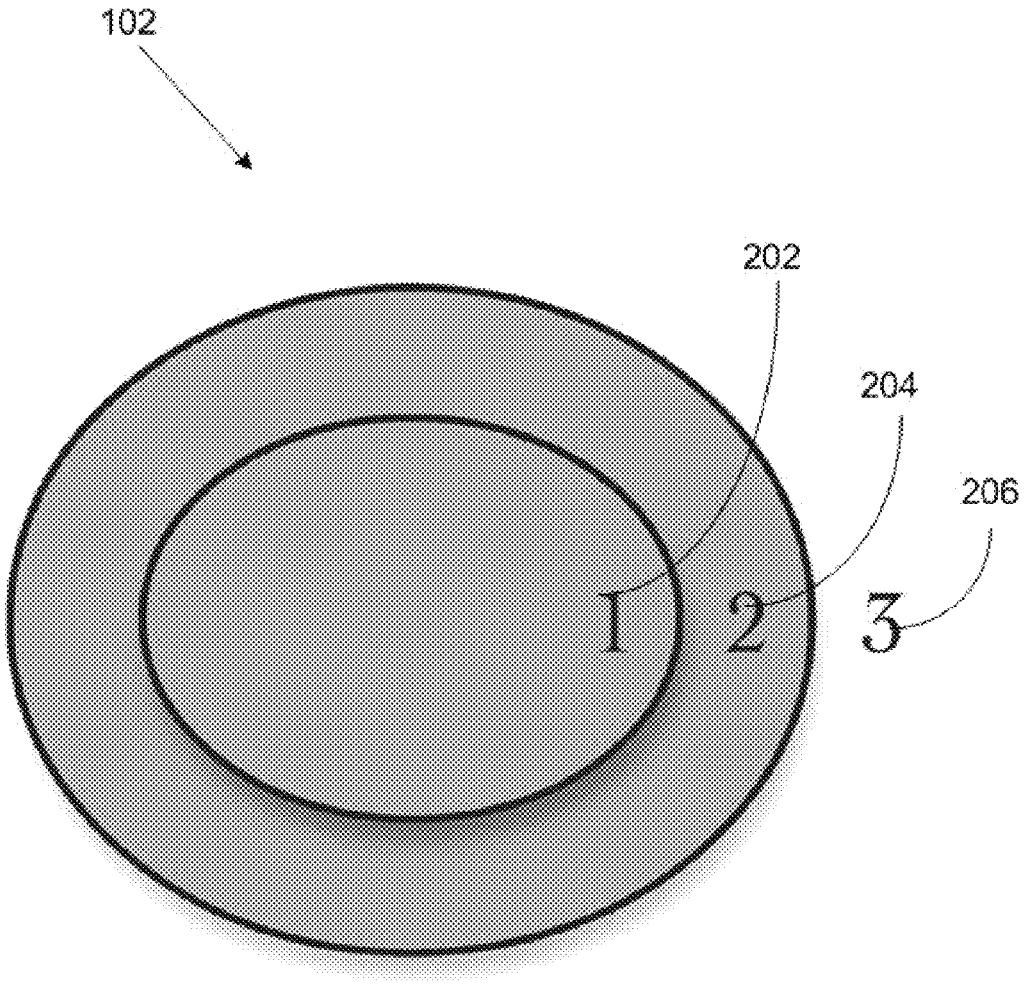
FIG. 2 illustrates a diagramed view of three exemplary layers for a protective system, in accordance with an embodiment of the present invention.

FIG. 2 illustrates a diagramed view of three exemplary layers for a protective system, in accordance with an embodiment of the present invention. In the present invention, the body portion may include a multiplicity of material layers and components that create a synergy to provide protection, accessibility, and aesthetics to the instrument cover. The body portion may include an inner layer 202 for engaging the instrument. The inner layer may include a soft material that will not damage the instrument. In one embodiment of the present invention, the body portion may include at last one intermediate layer 204 for insulating and retaining the form and contour of the instrument cover. Those skilled in the art, in light of the present teachings will recognize that the intermediate layer may be configured to conform to multiple sizes, shapes, and dimensions of instruments, including, without limitation woodwinds, and brass instruments. In one embodiment of the present invention, the body portion may include an exterior layer 206 for providing an exterior surface to the instrument cover. The exterior layer may include both functional and aesthetic features. The exterior layer may include the at least one pouch for holding instrument components, including, without limitation, a reed case, a mouthpiece, and a tuner. In one embodiment of the present invention, the exterior layer may include a handle for orienting and positioning the instrument cover on and/or off of the instrument.

In one embodiment of the present invention, the instrument cover may include an inner layer for engaging the instrument. The inner layer may provide a close, but not fully snug fit over the instrument. In this manner, the instrument cover may not snag or excessively rub against the instrument. The inner layer may include a soft material that will not damage the instrument. Suitable materials for the inner layer may include, without limitation, a fleece, nylon, an anti-tarnishing fabric, or cotton. In one embodiment of the present invention, the exterior layer may include at least one pouch for holding and protecting instrument components, including, without limitation, a reed case, a mouthpiece, and a tuner. However, the at least one pouch may further include a plethora of other items associated with music, including, without limitation, sheet music. The at least one pouch may also protect these items with a moisture and/or odor absorbing portion, such as, without limitation, a gel silica pack and baking soda.

In one embodiment of the present invention, the instrument cover may include at last one intermediate layer for insulating and retaining the form of the instrument cover. The at least one intermediate layer may provide the overall shape of the instrument cover, thereby providing the identification and instrument functionality for the instrument cover. Those skilled in the art, in light of the present teachings will recognize that the at least one intermediate layer may be configured to conform to multiple sizes, shapes, and dimensions of instruments, including, without limitation woodwinds, and brass. Suitable materials for the at least one intermediate layer may include, without limitation, polyether urethane, foam, plastic, polyvinyl chloride, silicone, and gel. In one embodiment, the at least one intermediate layer may include a ½" polyether urethane shell. In yet another embodiment, the at least one intermediate layer may include between ⅜" to ⅝" of foam. Those skilled in the art, in light of the present teachings will recognize that the at least one intermediate layer may include one, two, three, four, or more layers, depending on the required malleability and protection for the instrument. Various other factors in determining the amount of intermediate layers may include, without limitation, weight, strength, flexibility, and type of instrument. For example, without limitation, a flute may require a simple foam intermediate layer to prevent the keys from moving excessively, while a tuba may require a more rigid intermediate layer to protect against accidental fall from music stand.

In one embodiment of the present invention, the instrument cover may include an exterior layer for providing an exterior surface to the instrument cover. The exterior layer may include both functional and aesthetic features. The exterior layer may include various textures efficacious for resisting bacteria, providing grip, facilitating visibility, and classifying different instruments. For example, without limitation, a yellow exterior surface may be utilized for brass instruments, and a brown exterior surface may be utilized for woodwind instruments. In some embodiments, the exterior surface may include decorative features, including, without limitation, graphics, colors, various textures, logos, text, and illumination. In one alternative embodiment, the exterior surface may include a reflective surface for deflecting the rays of the sun. In one embodiment of the present invention, the exterior layer may include a handle for orienting and positioning the instrument cover on or off of the instrument. In one embodiment, the exterior layer may include the at least one pouch for holding and protecting instrument components, including, without limitation, a reed case, a mouthpiece, and a tuner.

Figure 3A:
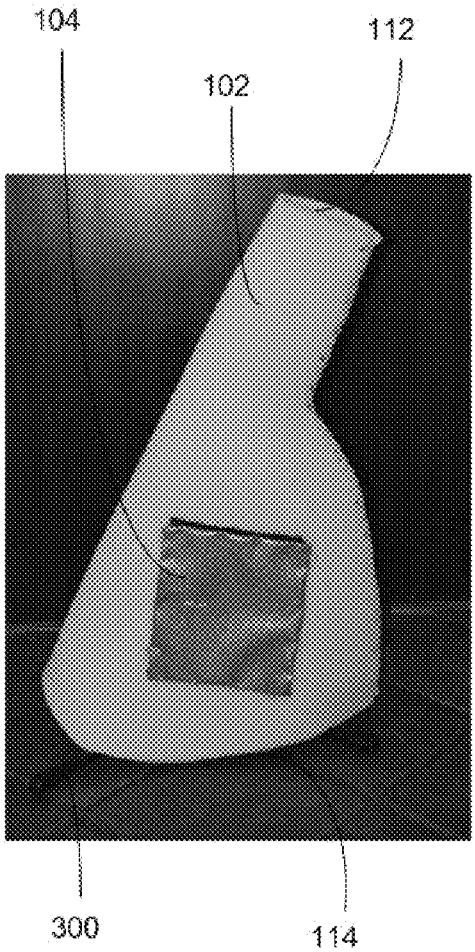
FIGS. 3A and 3B illustrate detailed perspective views of exemplary protective systems overlaying an exemplary instrument and an exemplary instrument stand, where
Figure 3B:
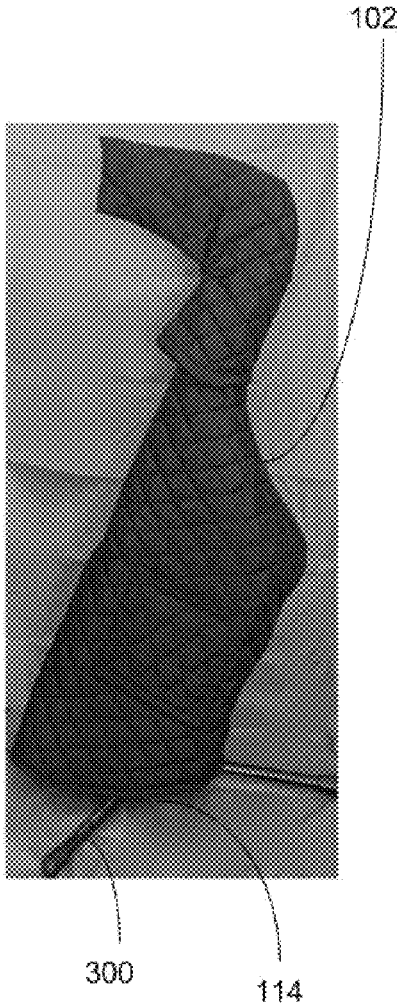

FIGS. 3A and 3B illustrate detailed perspective views of exemplary protective systems overlaying an exemplary instrument and an exemplary instrument stand, where FIG. 3A illustrates a first embodiment of an exemplary protective system, and FIG. 3B illustrates a second embodiment of an exemplary protective system, in accordance with an embodiment of the present invention. In the present invention, the instrument may rest on an instrument stand 300 for supporting the instrument when not in use. However, the instrument stand may also be used while operating the instrument, such as a drum stand. The body portion may be configured to cover both the instrument and the instrument stand. In some embodiments, the body portion may contour the shape and size of a particular instrument. However the body portion may have sufficient flexibility to conform to a variety of differently shaped and dimensioned instruments. In some embodiments, the body portion may provide less rigid protection than a typical instrument case, yet provide greater flexibility for positioning the instrument inside and retaining the instrument in an assembled configuration. In this manner, a fully assembled, ready to play instrument may be visibly positioned on an instrument stand for facilitated accessibility and availability.

Figure 4A:
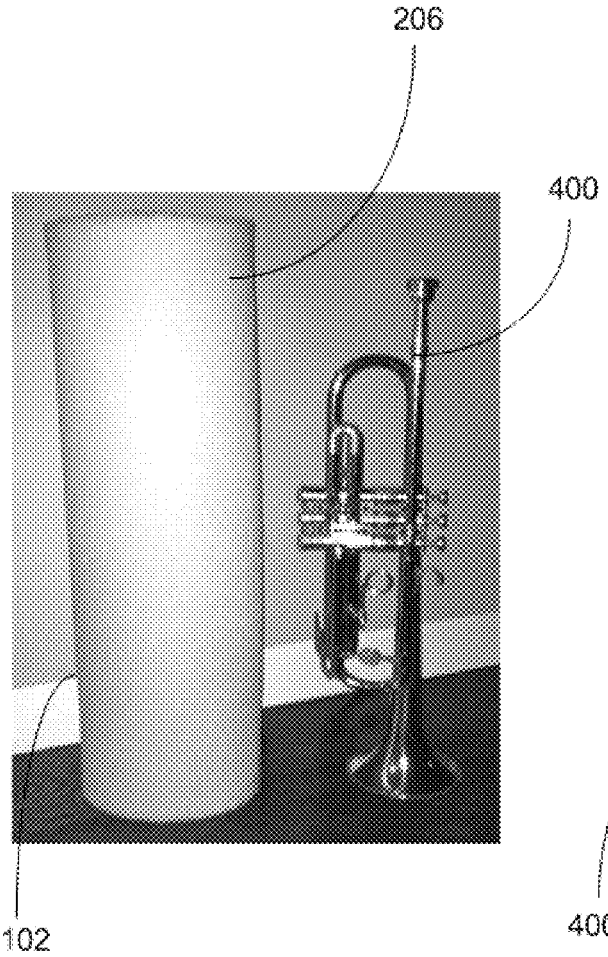
FIGS. 4A and 4B illustrate detailed perspective views of exemplary protective systems and an exemplary instrument, where
Figure 4B:
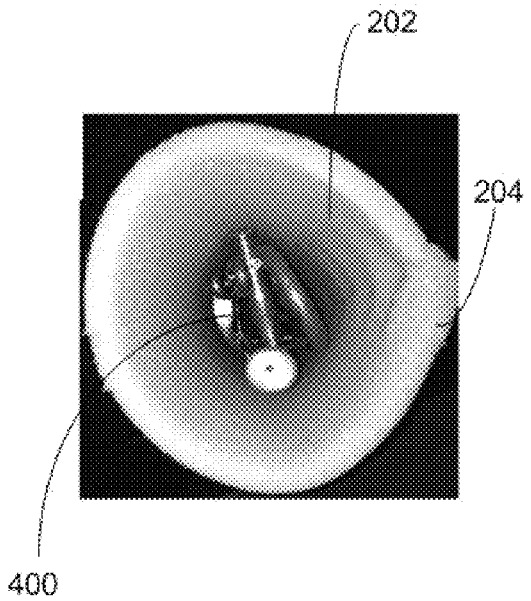

FIGS. 4A and 4B illustrate detailed perspective views of exemplary intermediated layer 204 protective systems and an exemplary instrument, where FIG. 4A illustrates a side view of an exemplary protective system adjacent to an exemplary instrument, and FIG. 4B illustrates a top view of an exemplary instrument covered by an exemplary protective system (with the top removed), in accordance with an embodiment of the present invention. In the present invention, an instrument 400 may pass through the bottom end of the body portion. In yet another embodiment, the body portion may simply wrap around the instrument. However in each embodiment, multiple layers—interior layer, intermediate layer, and exterior layer—provide unique and novel functionality for enhancing and protecting the instrument.

Figure 5A:
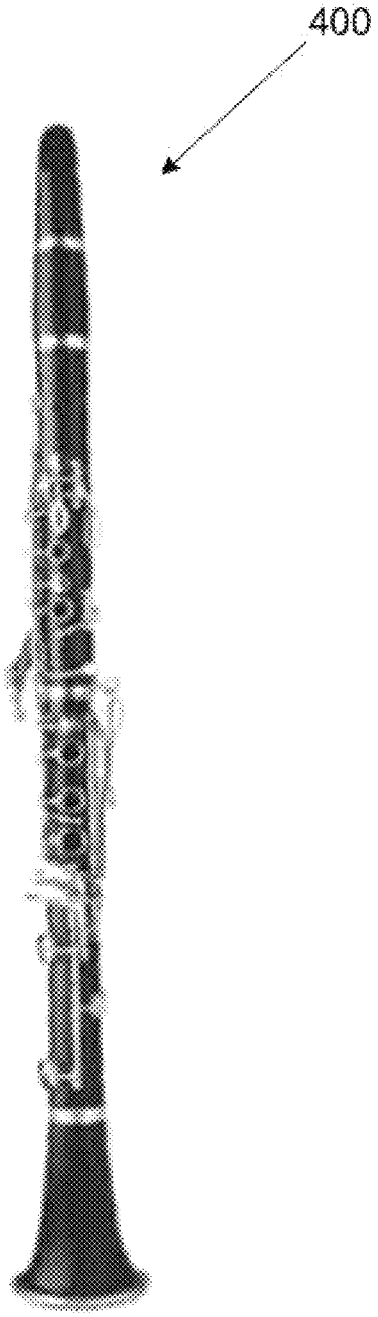
FIGS. 5A through 5M illustrate detailed perspective views of various types of exemplary musical instruments, where
Figure 5B:
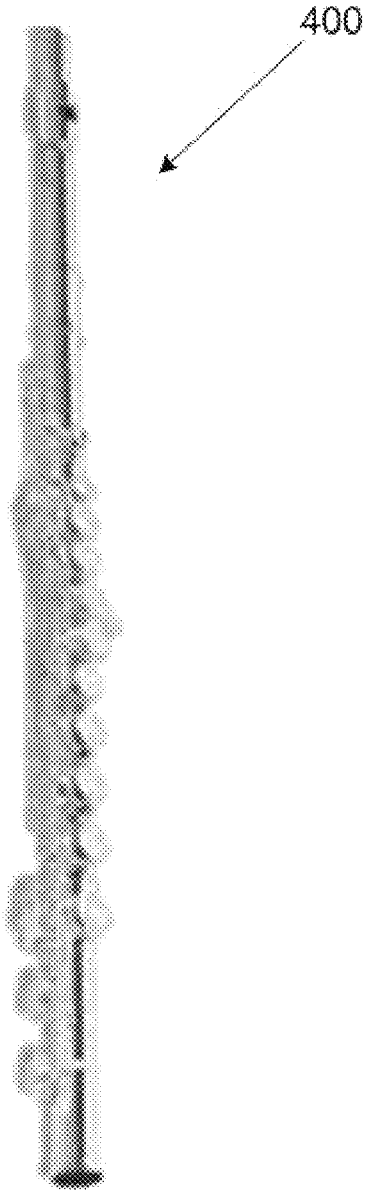
Figure 5C:
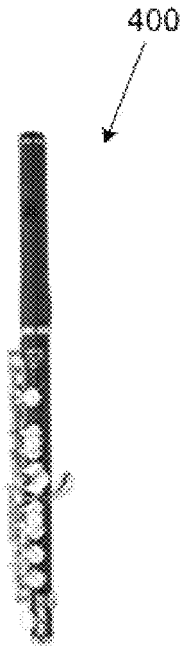
Figure 5D:
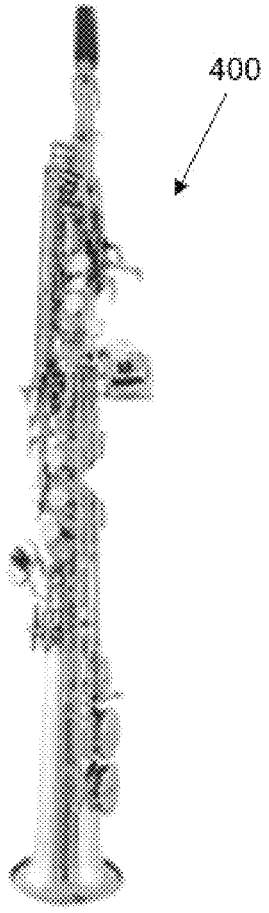
Figure 5E:
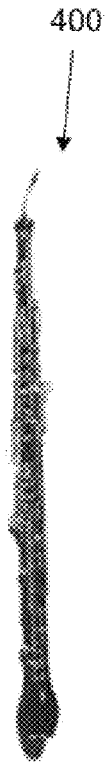
Figure 5F:
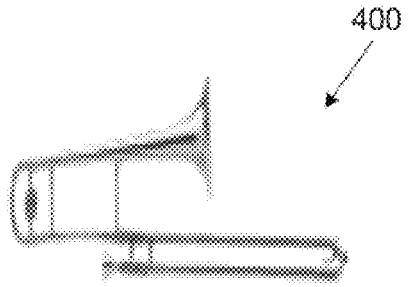
Figure 5G:
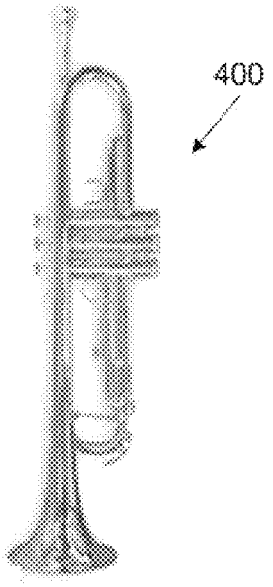
Figure 5H:
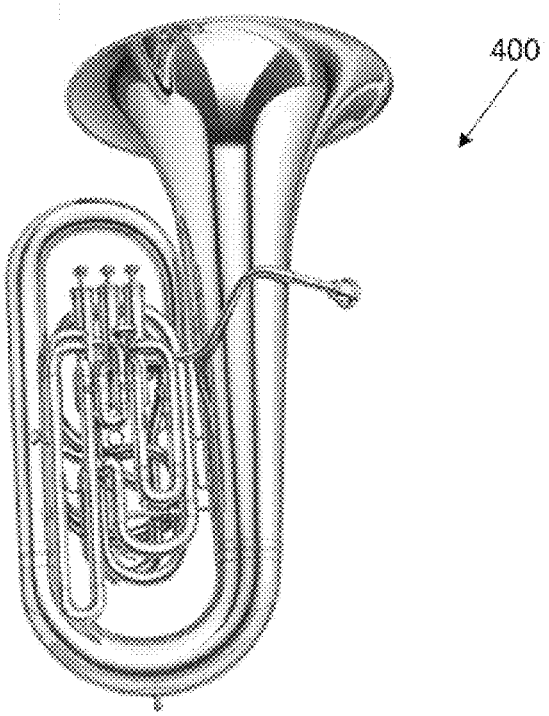
Figure 5I:
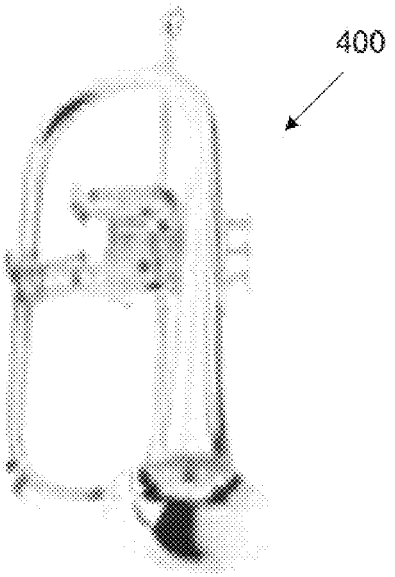
Figure 5J:
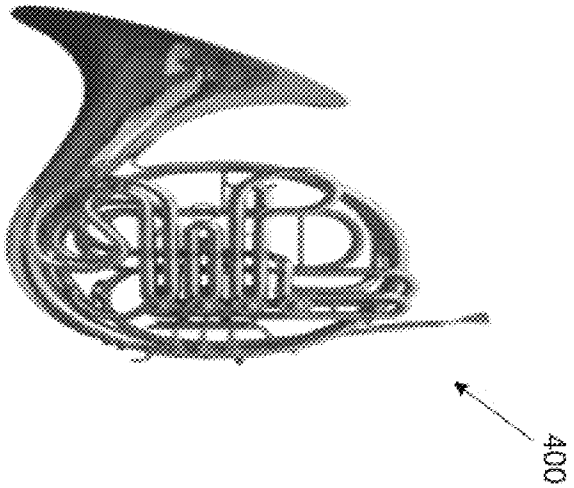
Figure 5K:
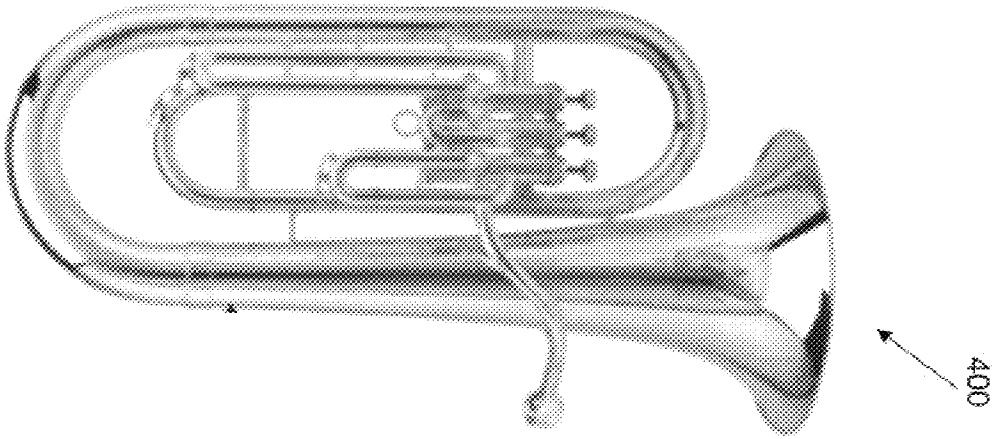
Figure 5L:
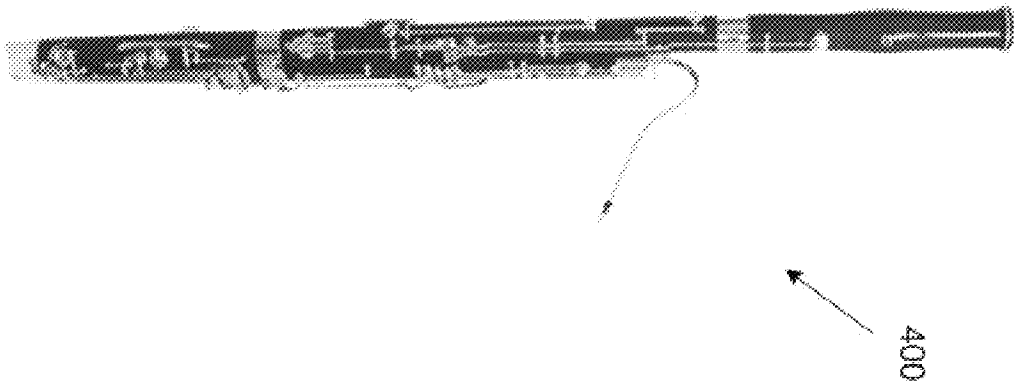
Figure 5M:
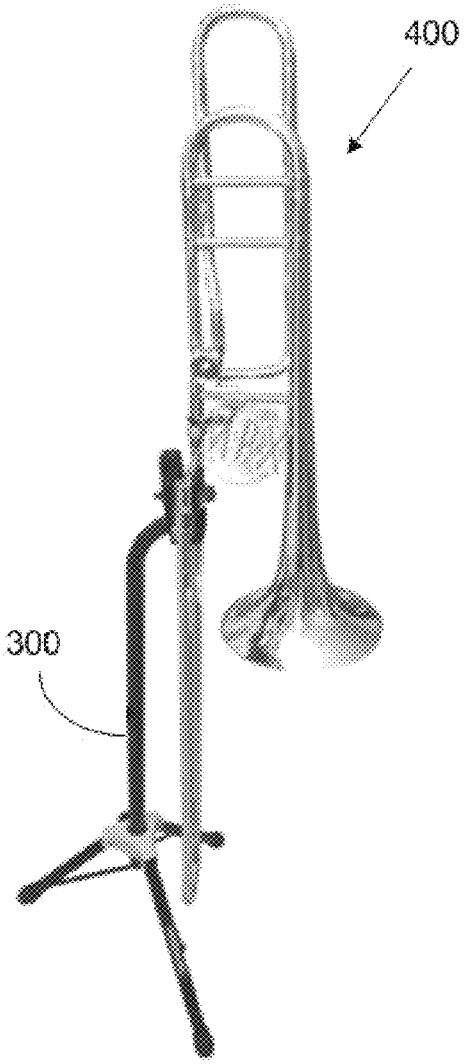

FIGS. 5A through 5M illustrate detailed perspective views of various types of exemplary musical instruments, where FIG. 5A illustrates an exemplary clarinet, FIG. 5B illustrates an exemplary instrument flute, FIG. 5C illustrates an exemplary piccolo, FIG. 5D illustrates an exemplary straight soprano saxophone, and FIG. 5E illustrates an exemplary English horn, FIG. 5F illustrates an exemplary trombone, FIG. 5G illustrates an exemplary trumpet, FIG. 5H illustrates an exemplary tuba, FIG. 5I illustrates an exemplary flugelhorn, FIG. 5J illustrates an exemplary French horn, FIG. 5K illustrates an exemplary euphonium, FIG. 5L illustrates an exemplary bassoon, and FIG. 5M illustrates an exemplary trombone on an exemplary music stand 300, in accordance with an embodiment of the present invention. In the present invention, the system may include a body portion that at least partially overlays the instrument. In some embodiments, the body portion may encapsulate the instrument. The body portion may be shaped to conform to various instruments. For example, without limitation, a cylindrical shaped body portion may cover clarinet. A rectangular shaped body portion may cover a trombone. An oval shaped body portion may cover a trumpet. A conical shaped body portion may cover a bass clarinet.

Those skilled in the art, in light of the present teachings will recognize that the instruments may be susceptible to damage if left uncovered. Wooden instruments may chip, crack, and warp. Brass instruments may bend due to the soft characteristic of brass. Further, the instruments include various small intricate components such as valves, springs, keys, pads, rods, and slides that may cause the instrument to play out of tune if damaged. The instrument cover provides the protection for the instrument to help eliminate these damages. The instrument may include, without limitation, woodwinds, and brass. Specifically, the instrument cover may be configured to cover myriad instruments, including, without limitation, a tuba, a flugelhorn, a trombone, a euphonium, a French horn, a saxophone, a trumpet, a flute, a clarinet, a coronet, and an oboe.

Figure 6A:
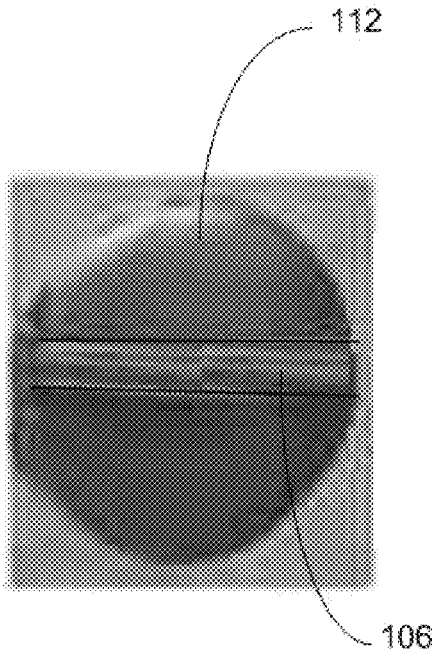
FIGS. 6A and 6B illustrate top views and bottom views of an exemplary instrument cover, in accordance with an embodiment of the present invention, where
Figure 6B:
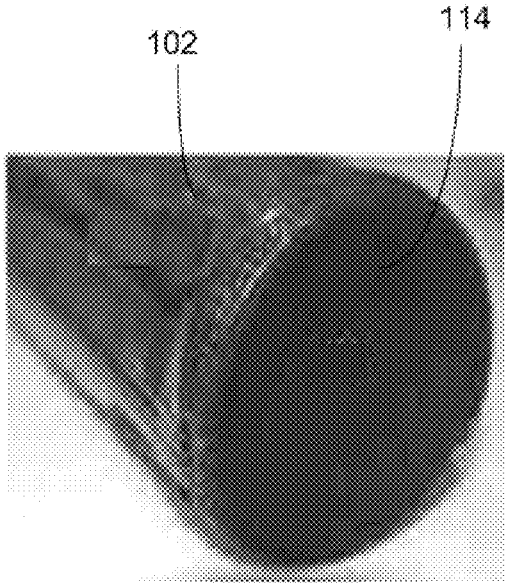

FIGS. 6A and 6B illustrate top views and bottom views of an exemplary instrument cover, in accordance with an embodiment of the present invention, where FIG. 6A illustrates a top view with an exemplary handle, and FIG. 6B illustrates a bottom view with access to an exemplary inner layer, in accordance with an embodiment of the present invention. In the present invention, the body portion may include one whole piece, or multiple sections that join together around the instrument. In some embodiments, the exterior layer may include a handle for orienting and positioning the instrument cover on or off of the instrument. In one embodiment, the exterior layer may include the at least one pouch for holding and protecting instrument components, including, without limitation, a reed case, a mouthpiece, and a tuner. All covers may include a florescent or reflective tape, or fabric to help locate the cover in a dark setting such as, but not limited to, an orchestra pit.

Figure 7:
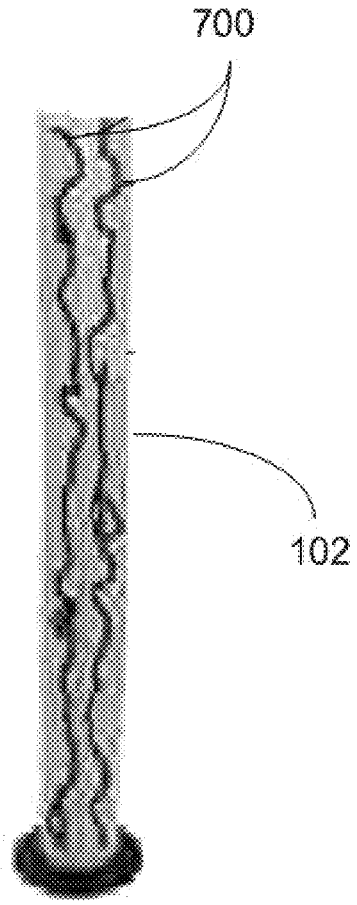
FIG. 7 illustrates a sectioned view of an exemplary instrument cover with at least one wire positioned between the inner layer and the intermediate layer, in accordance with an embodiment of the present invention.

FIG. 7 illustrates a sectioned view of an exemplary instrument cover with at least one wire positioned between the inner layer and the intermediate layer, in accordance with an embodiment of the present invention. In the present invention, the instrument cover may carry an electrical current for provide thermal energy to the instrument. At least one wire 700 may position along the any of the layers of the body portion. The at least one wire may receive electrical power from a power source, to generate the thermal energy. The at least one wire may include, without limitation, an insulated copper wire. Those skilled in the art, in light of the present teachings, will recognize that heating a brass instrument may create a more comfortable performance.

Figures 8A, 8B, 8C:
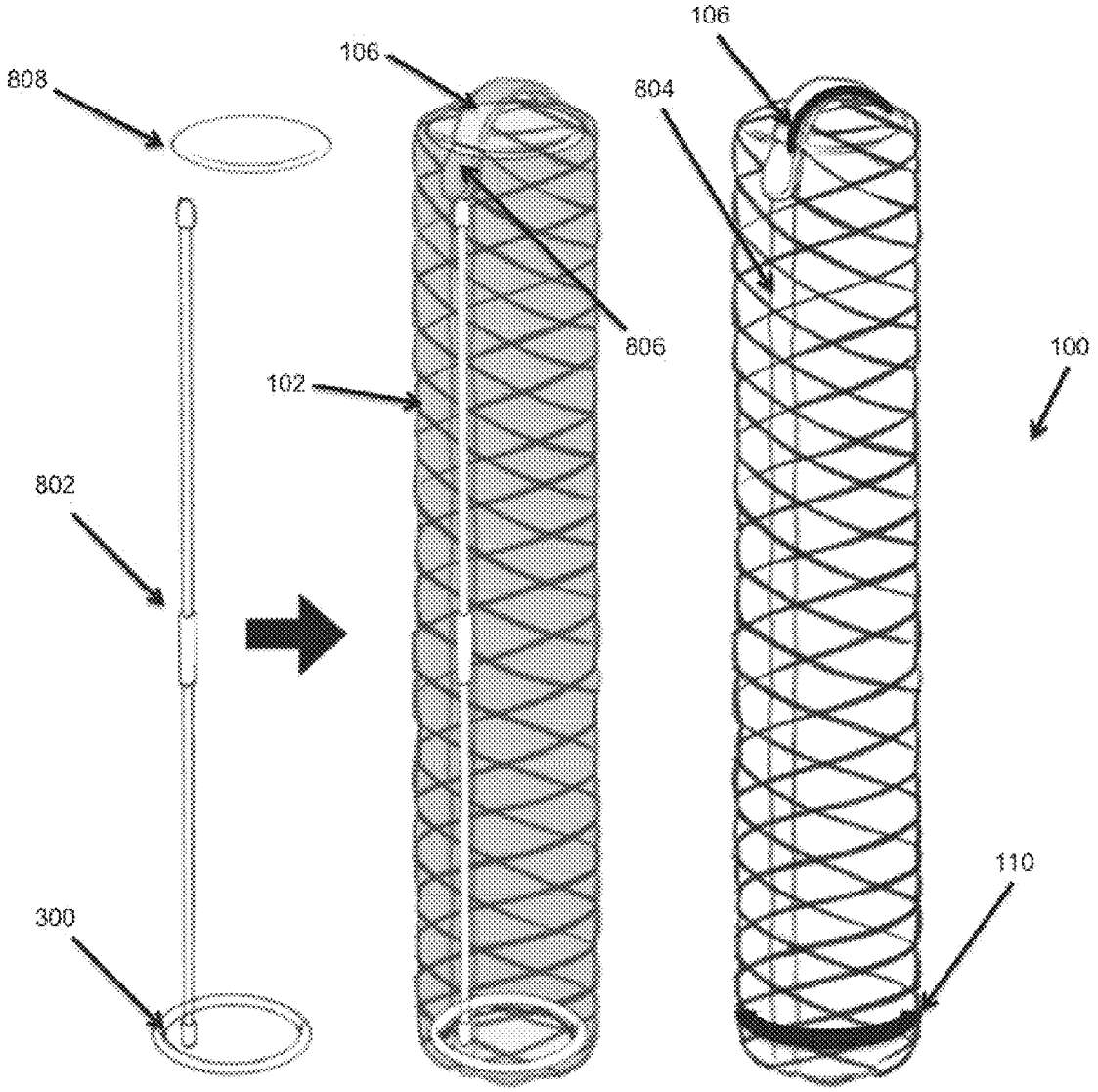
FIGS. 8A, 8B, and 8C illustrate detailed perspective views of an exemplary body portion supported by an exemplary support pole, where

FIGS. 8A, 8B, and 8C illustrate detailed perspective views of an exemplary body portion supported by an exemplary support pole, where FIG. 8A illustrates an exemplary support side pole, bottom ring, and protective foam top. FIG. 8B illustrates an cylindrical exemplary instrument cover with an exemplary pole sleeve receiving a support pole, a ring sewn in the bottom, and foam inserted in the top of exemplary instrument cover, and FIG. 8C illustrates an exemplary cylindrical instrument enhancing device in accordance with an embodiment of the present invention. In the present invention, the protective system may include a body portion that encapsulates the instrument. The body portion is configured to cover, but not touch or rub against the instrument. The body portion may be at least partially supported by a support pole 802. The support pole may include a rod having substantially the same height as the instrument. The support pole helps insure that the body portion minimizes contact with the instrument. In some embodiments, the support pole extends along a longitudinal axis of the body portion, in a pole sleeve 804. The pole sleeve forms a pocket that receives the support pole. In some embodiments, the support pole telescopically expands or collapses for extended size and storage.

The expandable embodiment of the support pole may help keep the body portion in an upright position and keeps the top of the body portion from resting on the instruments mouthpiece or head joint. The opening at the bottom of the cover may include metal, boning, or plastic. The metal, boning, or plastic may be sewn inside, or inserted into the bottom of the exemplary instrument cover to help keep the shape of the opening and add a slight amount of weight to provide ease of covering the instrument. The support pole and the instrument bottom insert work together to help restrict undesired movement by the body portion, such as flopping around. Suitable materials for the support pole may include, without limitation, metal, alloys, rigid polymers, and wood.

In some embodiments, the exterior layer may include a hoop 806. The hoop may be sized and dimensioned to enable a thumb or linear object at least partial entry. The hoop may be used to lift the body portion over the instrument. In some embodiments, the body portion may include an insert 808 for providing an upper section protection to the instrument. This may be useful for protecting mouthpieces and other sensitive components of the instrument. Generally, the lower section of the body portion remains uncapped and open. Suitable materials for the insert may include, without limitation, foam, metal, alloys, rigid polymers, and wood.

Figure 9A:
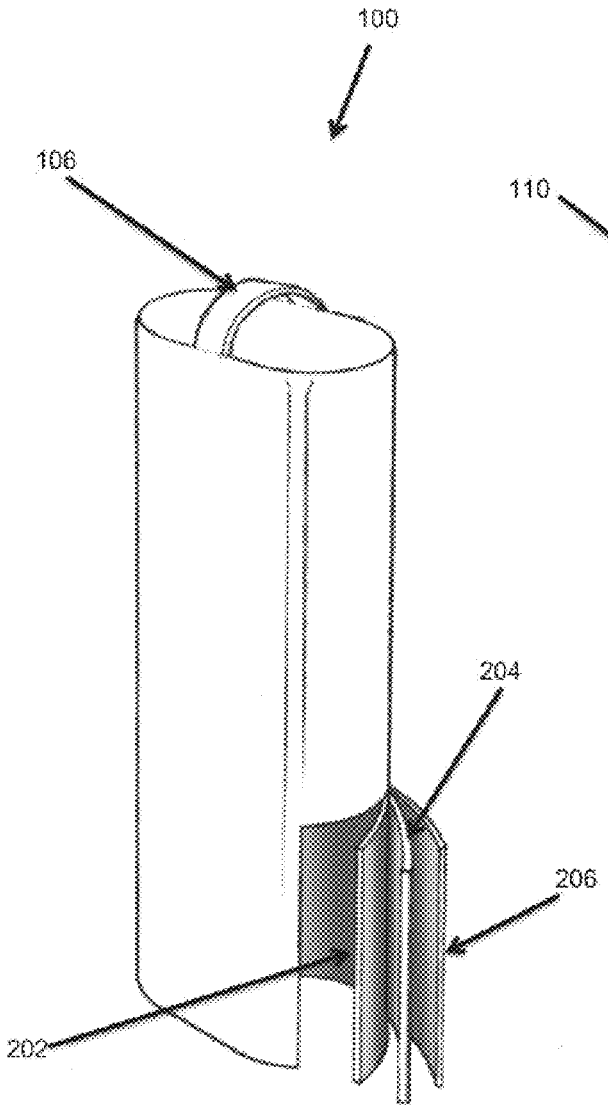
FIGS. 9A and 9B illustrate detailed perspective views of exemplary layers of a body portion, where
Figure 9B:
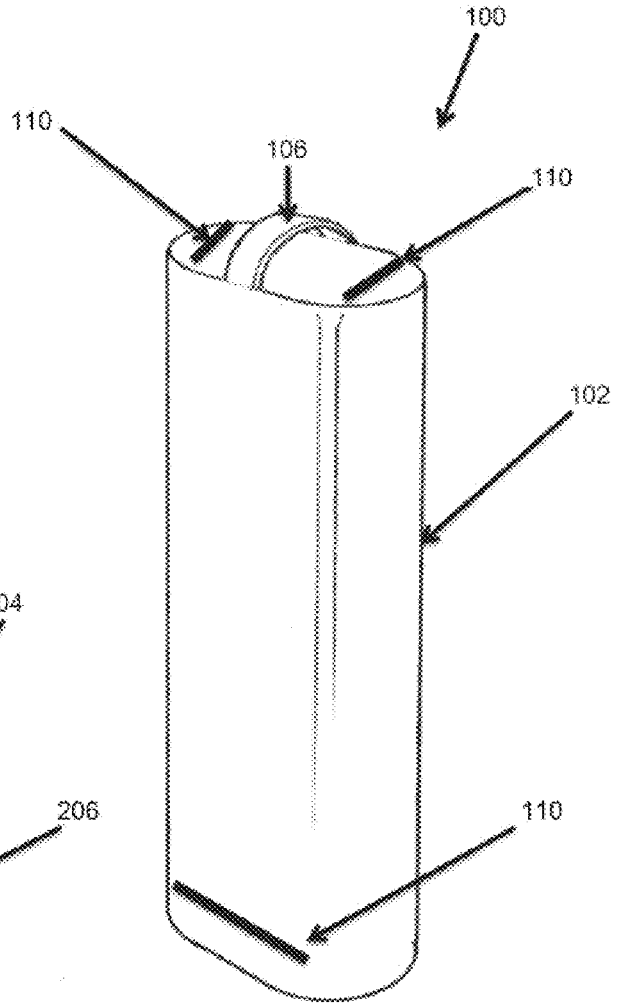

FIGS. 9A and 9B illustrate detailed perspective views of exemplary layers of a body portion, where FIG. 9A illustrates a sectioned view of an inner layer, an intermediate layer, and an exterior layer, and FIG. 9B illustrates an exemplary body portion with an exemplary handle and hoop, in accordance with an embodiment of the present invention. In the present invention, the body portion may include a multiplicity of material layers and components that create a synergy to provide protection, accessibility, and aesthetics to the instrument cover. The body portion may include an inner layer for engaging the instrument. The inner layer may include a soft material that will not damage the instrument. In one embodiment of the present invention, the body portion may include at last one intermediate layer for insulating and retaining the form and contour of the instrument cover.

In one embodiment, body portion may hover above the mouthpiece or head joint of the instrument. The inner layer may include a soft fabric, such as quilted fabric, or a tarnish resistant fabric, that does not snag the instrument, nor does it collect debris like dust or animal hair. The intermediate layer may include a layer of foam or a less structured insulation fabric. The exterior layer may be made of a decorative vinyl or quilted fabric.

Figures 10A, 10B, 10C:
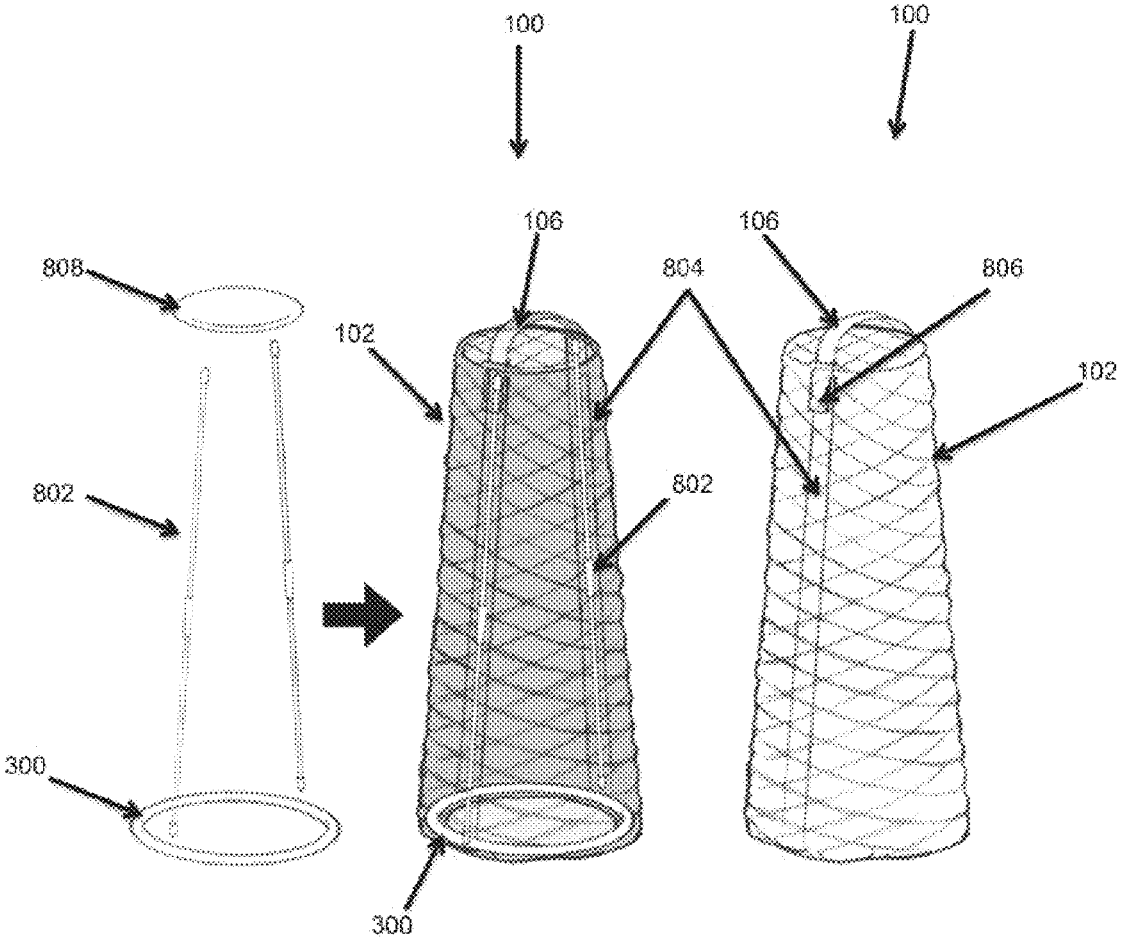
FIGS. 10A, 10B, and 10C illustrate detailed perspective views of an exemplary body portion covering a generally conical shaped instrument and exemplary instrument stand, where

FIGS. 10A, 10B, and 10C illustrate detailed perspective views of an exemplary body portion covering a generally conical shaped instrument and exemplary instrument stand, where FIG. 10A illustrates an exemplary support pole, FIG. 10B illustrates an exemplary pole sleeve receiving a support pole, a ring sewn in bottom of exemplary instrument cover, and foam inserted in top of exemplary instrument cover and FIG. 10C illustrates an exemplary handle and an exemplary hoop on an exterior layer of a body portion, in accordance with an embodiment of the present invention. In the present invention, the body portion may have various structural and visual effects. For example, without limitation, the support pole may be used for supporting body portions that have less rigidity. The exterior layer may be customized to display school, community band, city, or any organizations colors. A mascot or slogan can also be added to customize the cover.

Figure 11A:
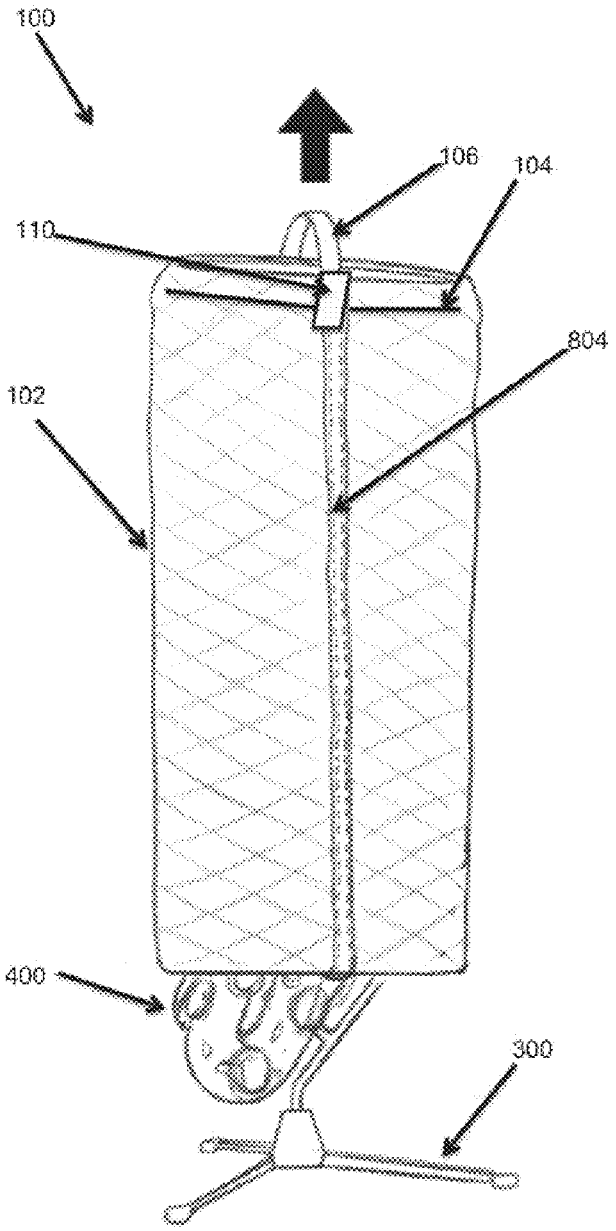
FIGS. 11A and 11B illustrate detailed perspective views of an exemplary body portion covering an exemplary instrument and an exemplary instrument stand, where
Figure 11B:
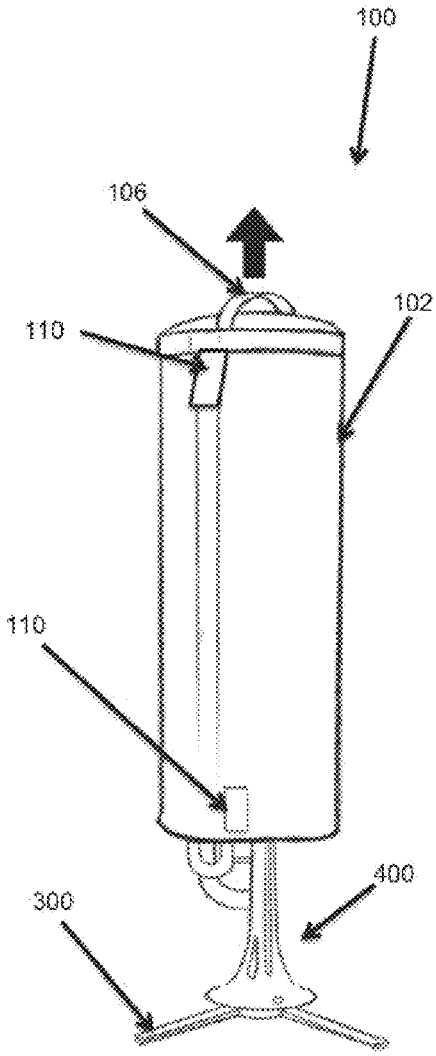

FIGS. 11A and 11B illustrate detailed perspective views of an exemplary body portion covering an exemplary instrument, where FIG. 11A illustrates the body portion removed from the instrument in an upward direction, and FIG. 11B illustrates an instrument enabling entry of an exemplary support pole for providing support, in accordance with an embodiment of the present invention. In the present invention, the body portion may be lifted upwardly to disengage from the instrument. The hoop may be utilized for this purpose.

Figure 12:
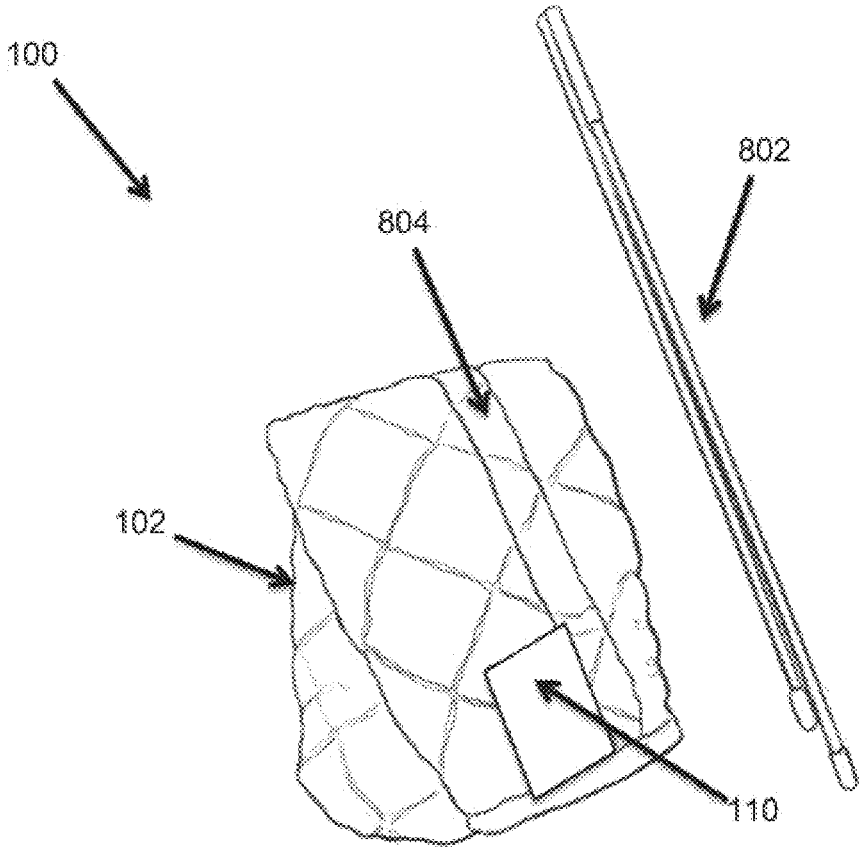
FIG. 12 illustrates a detailed perspective view of an exemplary instrument cover with the exemplary support pole removed allowing the cover to be folded to compact size for travel, or storage, in accordance with an embodiment of the present invention.

FIG. 12 illustrates a detailed perspective view of an exemplary body portion and an adjacent support pole, in accordance with an embodiment of the present invention. In the present invention, the body portion may conform to eclectic instrument types. The body portion provides a proximal cover that does not touch or rub against the instrument, or at least minimizes contact with the instrument.

In one alternative embodiment, the body portion may include an audio portion that mimics the type of instrument inside the instrument cover. In this manner, the instrument may be identified more easily when the body portion is covering the instrument. In yet another alternative embodiment, the body portion provides sufficient texture and depth to serve as a seat cushion while a musician is performing. In yet another alternative embodiment, the body portion compacts into a small shape for easy storage and portability. In yet another alternative embodiment, the at least one pouch includes a beverage pouch and a straw for refreshing the musician during a performance.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing a multilayered instrument cover for protecting and making more accessible instruments according to the present invention will be apparent to those skilled in the art. Various aspects of the invention have been described above by way of illustration, and the specific embodiments disclosed are not intended to limit the invention to the particular forms disclosed. The particular implementation of the multilayered instrument cover for protecting and making more accessible instruments may vary depending upon the particular context or application. By way of example, and not limitation, the multilayered instrument cover for protecting and making more accessible instruments described in the foregoing were principally directed to encapsulate musical instruments implementations. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A system comprising:

a body portion, said body portion being configured to at least partially cover an instrument, said body portion comprising an inner layer, said inner layer being configured to cover said instrument, said body portion further comprising at least one intermediate layer, said at least one intermediate layer comprising an insulating foam material and being configured to contour said body portion, said body portion further comprising an exterior layer, said exterior layer disposed to overlay said intermediate layer, said exterior layer being configured to provide a protective surface for said body portion;

wherein said exterior layer and said at least one intermediate layer are configured to sew onto said inner layer.

2. The system of claim 1, in which said body portion is supported with a support pole.

3. The system of claim 2, in which said body portion is configured to minimize contact with said instrument.

4. The system of claim 3, in which said body portion comprises a multiplicity of sections.

5. The system of claim 4, wherein said body portion comprises a system fastener, said system fastener being configured to regulate access to said body portion, said system fastener further being configured to secure said multiplicity of sections together.

6. The system of claim 5, in which said body portion comprises a top end and a bottom end.

7. The system of claim 6, wherein said at least one intermediate layer is operable to substantially conform to a shape of said instrument.

8. A system comprising:

a body portion, said body portion being configured to at least partially cover an instrument, said body portion comprising an inner layer, said inner layer being configured to cover said instrument, said body portion further comprising at least one intermediate layer, said at least one intermediate layer comprising an insulating foam material and being configured to contour said body portion, said body portion further comprising an exterior layer, said exterior layer disposed to overlay said intermediate layer, said exterior layer being configured to provide a protective surface for said body portion;

wherein said exterior layer comprises at least one pouch, said at least one pouch being configured to contain at least one instrument component;

wherein said exterior layer and said at least one intermediate layer are configured to sew onto said inner layer;

wherein said body portion is supported with a support pole;

wherein said body portion is configured to minimize contact with said instrument;

wherein said body portion comprises a multiplicity of sections;

wherein said body portion comprises a system fastener, said system fastener being configured to regulate access to said body portion, said system fastener further being configured to secure said multiplicity of sections together;

wherein said body portion comprises a top end and a bottom end; and, wherein said at least one intermediate layer is operable to substantially conform to a shape of said instrument.

9. The system of claim 8, wherein said exterior layer comprises a hoop, said hoop configured to be operable to be received by a hand for removing said body portion from said instrument.

10. The system of claim 8, in which said exterior layer comprises a handle, said handle being configured to be operable to be carried by a hand or strapped to a back.

11. The system of claim 8, wherein said exterior layer comprises a top insert said top insert being configured to form a protective upper surface for said instrument.

12. The system of claim 8, in which said exterior layer comprises a decorative surface, said decorative surface being configured to identify said instrument.

13. The system of claim 8, wherein said body portion comprises a pole sleeve adapted to receive the support pole.

14. The system of claim 8, in which said system comprises an instrument enhancing device, said instrument enhancing device comprising at least one moisture and/or odor absorbing composition, said at least one moisture and/or odor absorbing composition being disposed to position in a lower inside portion of said body portion.

15. The system of claim 8, in which said body portion comprises at least one wire, said at least one wire being configured provide thermal energy to said instrument, said at least one wire being disposed to position between said inner layer and said intermediate layer is substantially assembled.

16. The system of claim 8, wherein said support pole being disposed to position in a pole sleeve.

17. A method for using a system comprising:

a means for positioning an instrument on an instrument stand;

a means for orienting said system to at least partially cover said instrument;

a means for engaging said instrument with an inner layer;

a means for conforming a shape of at least one intermediate layer to said instrument;

a means for at least partially supporting said instrument with a support pole, the support pole pole received in a sleeve;

a means for accessing at least one pouch on an exterior layer;

a means for obtaining at least one instrument component from said at least one pouch; and a means for removing said system with a handle.

18. A system consisting of:

a body portion, said body portion comprising a top end and a bottom end, said body portion being configured to cover an instrument positioned on an instrument stand, said body portion further being configured to minimize contact with said instrument, said body portion comprising a multiplicity of sections, said multiplicity of sections being configured to join together to form said body portion, said body portion further comprising an inner layer, said inner layer being configured to engage said instrument, said body portion further comprising at least one intermediate layer, said at least one intermediate layer being configured to contour to said instrument, said at least one intermediate layer comprising an insulation portion, said body portion further comprising an exterior layer, said exterior layer being disposed to overlay said intermediate layer, said exterior layer being configured to provide an exterior surface for said body portion, said exterior layer comprising at least one pouch, said at least one pouch being configured to contain at least one instrument component, said exterior layer further comprising a handle, said handle being configured to be operable to be carried by a hand or wrapped around a shoulder, said exterior layer further comprising a hoop, said hoop being configured to be operable to be engaged by a hand for removing said body portion from said instrument, said body portion further comprising a top insert, said top insert being configured to form a protective upper surface for said instrument, said body portion further comprising a pole sleeve; and a support pole, said support pole being configured to at least partially support said instrument, said support pole being disposed to position in said pole sleeve, exterior may include florescent or reflective tape or material for ease of finding in dark settings.

* * * * *